US007104008B2

(12) United States Patent
Yokotachi

(10) Patent No.: US 7,104,008 B2
(45) Date of Patent: Sep. 12, 2006

(54) DOOR SYSTEM WITH A PAIR OF DOOR PANELS CONNECTED BY A SWIVEL PANEL THAT SWINGS BACK AND FORTH FOR SELECTIVELY OPENING AND CLOSING GATEWAYS IN A COMPARTMENT

(75) Inventor: Hiroyuki Yokotachi, Itabashi-ku (JP)

(73) Assignee: Nabco, Ltd., (JP)

( * ) Notice: Subject to any disclaimer, the term of this patent is extended or adjusted under 35 U.S.C. 154(b) by 52 days.

(21) Appl. No.: 10/378,112

(22) Filed: Feb. 27, 2003

(65) Prior Publication Data

US 2003/0182864 A1 Oct. 2, 2003

(30) Foreign Application Priority Data

Mar. 29, 2002 (JP) ..... 2002-095226
Oct. 22, 2002 (JP) ..... 2002-307330

(51) Int. Cl.
*E05D 15/02* (2006.01)

(52) U.S. Cl. ..... 49/42; 49/40; 49/41

(58) Field of Classification Search ..... 49/40, 49/41, 42, 326, 324; 109/8, 71
See application file for complete search history.

(56) References Cited

U.S. PATENT DOCUMENTS 841,696 A * 1/1907 Lang ..... 49/68
867,888 A * 10/1907 Lang ..... 49/42
953,983 A * 4/1910 Van Zandt ..... 49/40
1,184,725 A * 5/1916 Dawes ..... 49/68
1,273,463 A * 7/1918 Dawes ..... 49/40
3,562,953 A * 2/1971 Prickett et al. ..... 49/40
4,530,183 A * 7/1985 Heise et al. ..... 49/42
4,557,073 A * 12/1985 Sandling ..... 49/41
4,843,761 A * 7/1989 Sandling ..... 49/41
4,928,429 A * 5/1990 Colombo ..... 49/41
5,076,013 A * 12/1991 Gallenschutz et al. ..... 49/42
5,526,615 A * 6/1996 Kaizu et al. ..... 52/79.6
5,542,211 A * 8/1996 Colombo ..... 49/42
6,061,960 A 5/2000 Korai

FOREIGN PATENT DOCUMENTS

JP 50-63741 5/1975
JP 10-292739 11/1998
JP 2002-70436 3/2002

* cited by examiner

*Primary Examiner*—Gregory J. Strimbu
(74) *Attorney, Agent, or Firm*—Gerald E. Hespos; Anthony J. Casella

(57) ABSTRACT

A door system has a compartment formed with a first gateway and a second gateway opposed to the first gateway, and a barrier apparatus housed in the compartment. The barrier apparatus includes a swivel panel which swings back and forth between a first position where one surface of the swivel panel faces the first gateway, and a second position where the opposite surface of the swivel panel faces the first gateway. The barrier apparatus further includes a pair of door panels provided at the opposite ends of the swivel panel to move with the swivel panel. The door panels synchronously open the gateways when the swivel panel is at the first position and at the second position. Air sealing is provided between the compartment and the door panels.

5 Claims, 15 Drawing Sheets

DOOR SYSTEM WITH A PAIR OF DOOR PANELS CONNECTED BY A SWIVEL PANEL THAT SWINGS BACK AND FORTH FOR SELECTIVELY OPENING AND CLOSING GATEWAYS IN A COMPARTMENT

BACKGROUND OF THE INVENTION

1. Field of the Invention

This invention relates to a door system with draught eliminating effect for use in an entrance/exit of a building.

2. Description of the Related Art

Heretofore, there is known an automatic sliding door provided at an entrance/exit of a building such as office buildings and public buildings. Such an automatic sliding door is provided to keep an air-conditioned state inside the building and/or to prevent draught from coming inside the building.

In the conventional automatic door system, for example, a box shaped compartment is defined in an entrance zone of a building, an entrance and an exit are defined in positions opposing to each other of the compartment, and a pair of automatic sliding doors are provided on the entrance and the exit, respectively. Each of the automatic doors is individually controlled in such a manner that the door is opened each time a passerby passes the compartment.

In the above-constructed automatic door system, a certain draught eliminating effect is secured by the compartment. However, in a case that a passerby is about to come into the compartment through the entrance door (exit door), and almost at the same timing, another passerby who is on the way of passing the compartment is about to go out of the compartment through the exit door (entrance door), or traffic of passersby through the compartment is heavy, it is highly likely that a situation where both of the entrance door and the exit door are opened may occur. Thus, the conventional automatic door system fails to accomplish complete draught eliminating effect.

Furthermore, in the above arrangement, since each of the automatic doors is individually opened and closed, two driving sources are needed. This may raise the production cost and running cost of the door system.

There is also known another type of door system, namely, a revolving door. A revolving door is operated in such a manner that a plurality of door panels are rotated around a central rotating element in a fixed direction. Such a revolving door system provides more secured draught eliminating effect than the automatic sliding door system because there are defined a certain number of small sections by the door panels. However, the revolving door system requires a relatively large space and requires signal communication between the door panels by slip rings, which raises the production cost and running cost of the door system.

SUMMARY OF THE INVENTION

In view of the above problems residing in the prior art, an object of the invention is to provide a door system that enables to secure draught eliminating effect at a low cost.

According to an aspect of the invention, a door system is provided with a compartment formed with a first gateway and a second gateway opposed to the first gateway, and a barrier apparatus housed in the compartment. The barrier apparatus includes a swivel panel which swings back and forth within an angular displacement of 180° or less, a pair of door panels provided at the opposite ends of the swivel panel, the door panels operatively opening and closing the first gateway and the second gateway respectively at the same timing while keeping contact with the compartment, and a driving mechanism which operatively swings the swivel panel back and forth. The swivel panel selectively swings in such a direction that one surface of the swivel panel faces the first gateway when the swivel panel swings in one direction, whereas the opposite surface of the swivel panel faces the first gateway when the swivel panel swings in the opposite direction.

In the above arrangement, when the swivel panel swings in one direction, the first gateway and the second gateway are opened, and the swivel panel renders the compartment to a state where the compartment is separated into an indoor zone communicating with the indoor and an outdoor zone communicating with the outdoor. In this state, communication between the indoor zone and the outdoor zone in the compartment is blocked by the swivel panel.

On the way of swinging in the other direction, the door panels close the first and second gateways, respectively, and the compartment comes into another state where the compartment is separated into two sections by the swivel panel, and communication between the two sections is blocked by the swivel panel. While the compartment is in this state, communication between the indoor and the outdoor in the compartment is also blocked, and a passerby is allowed to pass a passage defined by the swivel panel and an inner surface of the compartment with draught eliminating effect being secured.

The door panels for opening and closing the first gateway and the second gateway are jointed to the swivel panel and constitute a one-piece unit. Accordingly, the opening and closing of the gateway can be accomplished by the driving mechanism.

These and other objects, features and advantages of the present invention will become more apparent upon a reading of the following detailed description and accompanying drawing.

BRIEF DESCRIPTION OF THE DRAWINGS

FIGS. 4A through 4E are plan views showing a sequence of operations of the door system of a first embodiment, wherein FIG. 4A shows the door system where the entrance has just been opened to accommodate a person, FIG. 4B shows the entrance being closed, FIG. 4C shows the entrance and the exit fully closed, FIG. 4D shows the exit being opened and FIG. 4E shows the exit fully opened so that the person can leave the door system.

FIGS. 5A through 5E are plan views showing a sequence of operations of the door system of a second embodiment, wherein FIG. 5A shows the door system where the entrance has just been opened to accommodate a person, FIG. 5B shows the entrance being closed, FIG. 5C shows the entrance and the exit fully closed, FIG. 5D shows the exit being opened and FIG. 5E shows the exit fully opened so that the person can leave the door system.

FIGS. 6A through 6E are plan views showing a sequence of operations of the door system of a third embodiment, wherein FIG. 6A shows the door system where the entrance has just been opened to accommodate a person, FIG. 6B shows the entrance being closed, FIG. 6C shows the entrance and the exit fully closed, FIG. 6D shows the exit being opened and FIG. 6E shows the exit fully opened so that the person can leave the door system.

FIGS. 7A through 7E are plan views showing a sequence of operations of the door system of a third embodiment, wherein FIG. 7A shows the door system where the entrance has just been opened to accommodate a person, FIG. 7B shows the entrance being closed, FIG. 7C shows the entrance and the exit fully closed, FIG. 7D shows the exit being opened and FIG. 7E shows the exit fully opened so that the person can leave the door system.

FIGS. 9A through 9E are plan views showing a sequence of operations of the door system of a second embodiment, wherein FIG. 9A shows the door system where the entrance has just been opened to accommodate people, FIG. 9B shows the entrance being closed, FIG. 9C shows the entrance and the exit fully closed, FIG. 9D shows the exit being opened and FIG. 9E shows the exit fully opened so that the people can leave the door system.

FIGS. 10A through 10E are plan views showing a modification of the sixth embodiment corresponding to FIGS. 9A through 9E, respectively, wherein FIG. 10A shows the door system where the entrance has just been opened to accommodate people, FIG. 10B shows the entrance being closed, FIG. 10C shows the entrance and the exit fully closed, FIG. 10D shows the exit being opened and FIG. 10E shows the exit fully opened so that the people can leave the door system.

FIGS. 11A through 11E are plan views showing a sequence of operations of the door system of a seventh embodiment, wherein FIG. 11A shows the door system where the entrance has just been opened to accommodate people, FIG. 11B shows the entrance being closed, FIG. 11C shows the entrance and the exit fully closed, FIG. 11D shows the exit being opened and FIG. 11E shows the exit fully opened so that the people can leave the door system.

FIGS. 12A through 12E are plan views showing a sequence of operations of the door system of an eighth embodiment, wherein FIG. 12A shows the door system where the entrance has just been opened to accommodate people, FIG. 12B shows the entrance being closed, FIG. 12C shows the entrance and the exit fully closed, FIG. 12D shows the exit being opened and FIG. 12E shows the exit fully opened so that the people can leave the door system.

FIGS. 13A through 13E are plan views showing a sequence of operations of the door system of a ninth embodiment, wherein FIG. 13A shows two door panels swinging in opposite directions to open entrances and exits, FIG. 13B shows the door panels swinging to close both entrances and exits, FIG. 13C shows both door panels oriented to fully close the entrances and exits, FIG. 13D shows both door panels swinging to open both entrances and exists and FIG. 13E shows both door panels in positions for substantially fully opening both entrances and exits.

DESCRIPTION OF THE PREFERRED EMBODIMENTS OF THE INVENTION

Figure 1:
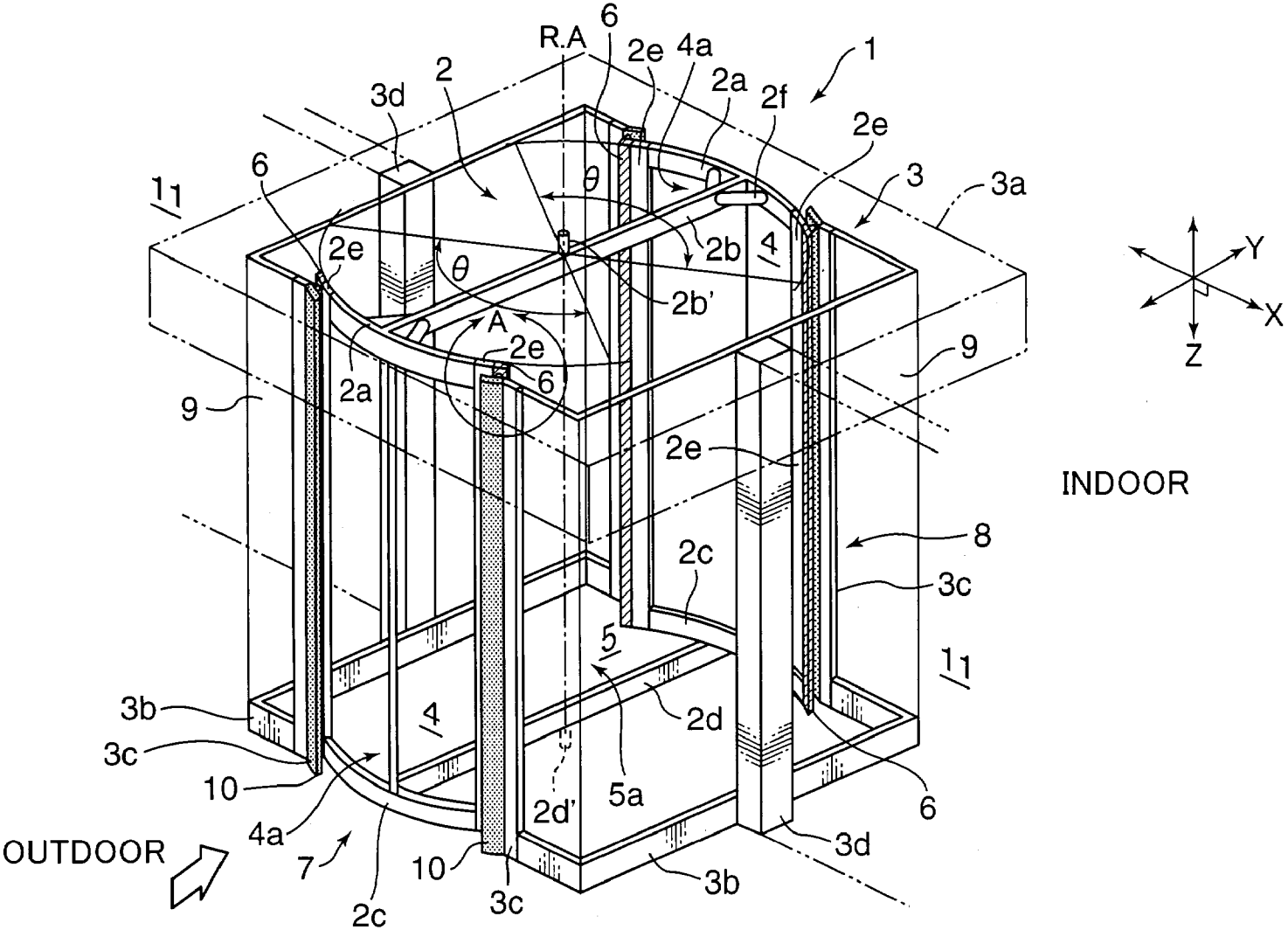
FIG. 1 is a perspective view showing an arrangement of a door system in accordance with an embodiment of the invention.

Referring to FIG. 1, a door system 1 incorporates a swivel panel unit 2 and a compartment 3 for housing the swivel panel unit 2 therein. The swivel panel unit 2 swings around an axis of rotation R.A. clockwise and counterclockwise alternately at an angular displacement of $\Theta$ ($\leqq 180°$). The swivel panel unit 2 and a driving mechanism, which will be described later, constitute a barrier apparatus.

At an upper part of the swivel panel unit 2, provided are a pair of upper outer frames 2*a*, 2*a* each in the form of an arc in plan view, and an upper joint frame 2*b* with opposite longitudinal ends thereof being jointed to a middle part of the respective upper outer frames 2*a*, 2*a*. The upper outer frames 2*a*, 2*a*, and the upper joint frame 2*b* are assembled into a generally H-shape in plan view.

Similar to the upper part of the swivel panel unit 2, there are provided, at a lower part of the swivel panel unit 2, a pair of lower outer frames 2*c*, 2*c* each in the form of an arc in plan view, and a lower joint frame 2*d* with opposite longitudinal ends thereof being jointed to a middle part of the respective lower outer frames 2*c*, 2*c*. The lower outer frames 2*c*, 2*c*, and the lower joint frame 2*d* are assembled into a generally H-shape in plan view.

An upper pin 2*b*' and a lower pin 2*d*' extend outwardly and coaxially with the axis of rotation R.A. on the upper joint frame 2*b* and the lower joint frame 2*d*, respectively.

Two post frames 2*e*, 2*e* are jointed to the opposite ends of each one of the upper outer frames 2*a*, 2*a* and to the opposite ends of the corresponding one of the lower outer frames 2*c*, 2*c* in such a manner that the two post frames 2*e*, 2*e* and the corresponding upper outer frame 2*a* and the corresponding lower outer frame 2*c* are jointed one to another to constitute a doorframe. A glass panel 4 having a curved plane is fitted in the doorframe.

The glass panel 4 and the doorframe surrounding the glass panel 4 constitute a door panel 4*a*. A glass panel 5 of a flat plane is fitted in between the upper joint frame 2*b* and the lower joint frame 2*d*. The glass panel 5, the upper joint frame 2*b*, and the lower joint frame 2*d* constitute a swivel panel or partition panel 5*a*.

At a lead end of a lateral portion of each post frame 2*e* in a swinging direction of the door panel 4*a*, attached is an elongated rubber switch 6 to prevent a passerby and/or his belonging from being stuck in a clearance between the door panel 4*a* and the compartment 3.

The compartment 3 has a box-like shape for housing the swivel panel unit 2. An outdoor gateway (first gateway) 7 accessible to the outside of a building on which the door system is installed, and an indoor gateway (second gateway) 8 accessible to the inside of the building are defined at locations opposing to each other in the compartment 3. The outdoor gateway 7 (indoor gateway 8) has a contour generally in conformance with the configuration of the door panel 4*a*.

The compartment 3 has a pair of glass panels 9, 9 opposing to each other, each having a generally U-shape in plan view. Respective upper end portions of the glass panels 9, 9 are jointed to a generally quadrangular top wall 3*a* of the compartment 3, and respective lower ends thereof are fixed to generally U-shaped lower base frame 3*b*, 3*b*. Reference numerals 3*c*, 3*d* denote columns each of which vertically extends and joints the top wall 3*a* and the lower base frame 3*b* of the compartment 3. The columns 3*c*, 3*c* are arranged at a lateral portion at the opposite ends of each glass panel 9 and constitute a part of the perimeter of the indoor gateway 8 (or outdoor gateway 7). The columns 3*d*, 3*d* respectively support generally a middle part of the glass panels 9, 9 in passing direction of passersby.

An elongated rubber switch 10 is attached to a tip end of a lateral portion of the column 3*c* to prevent a passerby and/or his belonging from being stuck in a clearance between the door panel 4*a* and the compartment 3. Reference number 11 denotes an outer surface of the building to which the door system is applied.

Figure 2:
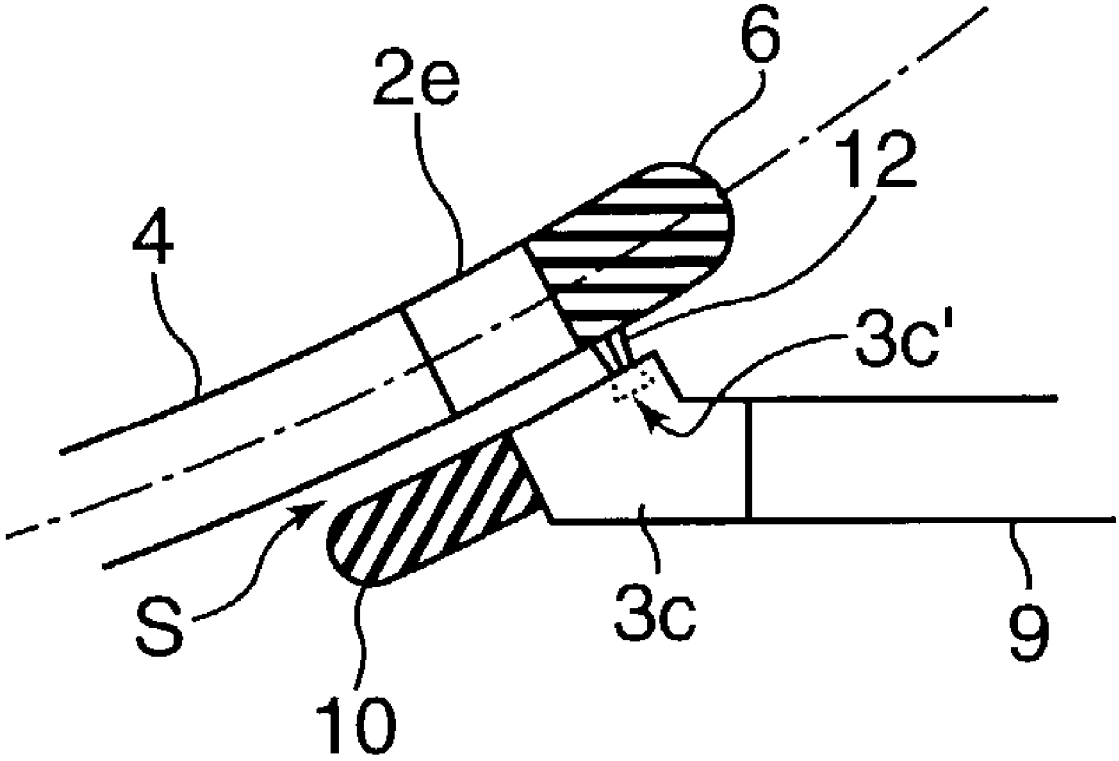
FIG. 2 is an enlarged view of the portion A shown in FIG. 1.

FIG. 2 is a plan view enlargedly showing the portion A of FIG. 1 indicated by the arrow-pointed incomplete circle. As shown in FIG. 2, when operation of the swivel panel unit 2 is suspended, the columns 3*c* of the compartment 3 and the corresponding post frames 2*e* of the swivel panel unit 2 are generally opposed to each other, respectively.

A groove 3*c*' (see FIG. 2) is formed in an inner surface of the column 3*c* in the Z-direction (see FIG. 1). An elongated brush 12 is fixedly mounted in the groove 3*c*'. The brush 12 is provided at each of the columns 3*c* defining the outdoor gateway 7 (indoor gateway 8) to block streams of air coming inside the compartment 3 through a clearance S by keeping contact with the outer surface of the swivel panel unit 2.

Figure 3:
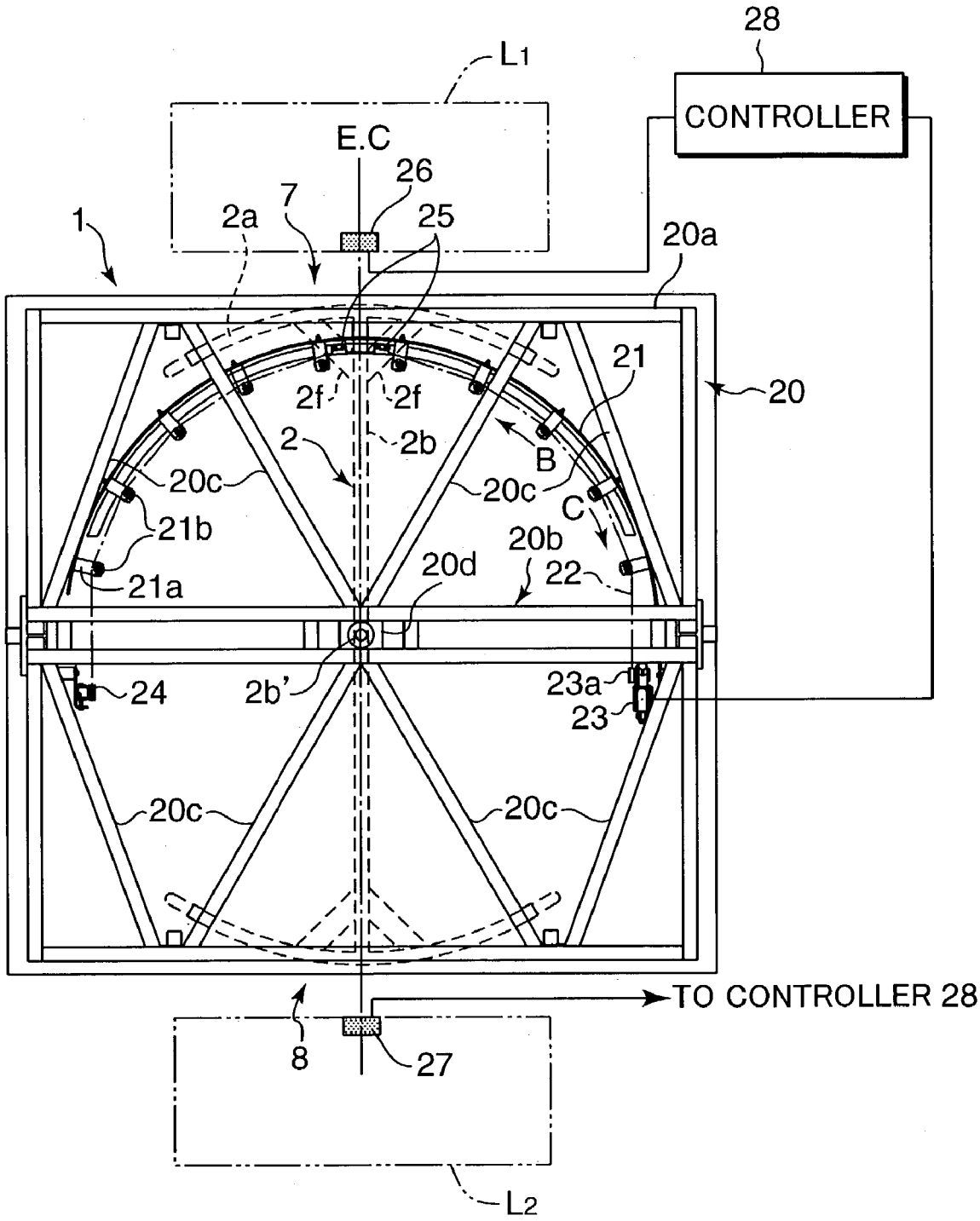
FIG. 3 is a plan view showing a driving mechanism for swinging a swivel panel unit shown in FIG. 1.

FIG. 3 is a diagram showing a driving mechanism of swinging the swivel panel unit 2. In FIG. 3, reference numeral 20 denotes a frame unit built in the top wall 3*a* of the compartment 3. The frame unit 20 incorporates a generally quadrangular frame portion 20*a*, a main beam 20*b* which extends transversely across the centroid of the frame portion 20*a*, and a plurality of supportive beams 20*c* each of which joints the frame portion 20*a* and the main beam 20*b*.

At a central part of the main beam 20*b*, a bearing 20*d* is provided to support the upper pin 2*b*' of the swivel panel unit 2. Likewise, the lower pin 2*d*' is supported by a bearing (not shown) which is buried in the floor of the compartment 3.

Reference numeral 21 denotes a guide plate of a semi-circular shape in plan view. The guide plate 21 is fixed to the supportive beams 20*c*. A number of brackets 21*a* are arranged at a certain interval along the guide plate 21 in such a manner that each bracket 21*a* extends inwardly from the guide plate 21. A guide roller 21*b* is mounted at a free end of each bracket 21*a*.

With the guide rollers 21*b*, an endless geared belt 22 is allowed to travel in a semi-circular configuration. One end of the endless geared belt 22 is wound around a drive pulley 23*a* coupled to a motor 23, and the other end thereof is wound around a driven pulley 24 which is fixed to the frame portion opposite to the frame portion where the motor 23 is mounted.

Clamps 25 are mounted on a substantially intermediate part of the geared belt 22. Each clamp 25 is connected with a supportive pipe 2*f* which supports the upper outer frame 2*a*.

In the above arrangement, when the motor 23 is rotated forward or backward by a given amount, the geared belt 22 travels in the direction of arrow B or arrow C in FIG. 3, and the swivel panel unit 2 fixed to the geared belt 22 by way of the clamps 25 swings with respect to the centerline E.C. connecting a transverse center point of the indoor gateway 8 and a transverse center point of the outdoor gateway 7 clockwise or counterclockwise (rightward direction or leftward direction in FIG. 3) alternately. By swinging the swivel panel unit 2 in rightward direction and leftward direction alternately, the outdoor gateway 7 and the indoor gateway 8 are opened and closed alternately.

In FIG. 3, $L_1$ and $L_2$ denote zones of the outdoor gateway 7 and the indoor gateway 8 respectively detectable by sensors 26 and 27. The sensor 26 (27) sends a detection signal to a controller 28 when the sensor 26 (27) detects a passerby approaching the outdoor gateway 7 (indoor gateway 8). The controller 28, in receipt of the detection signal, controls the motor 23 to swing the swivel panel unit 2 in a certain direction.

Next, an operation of the above-constructed door system is described with reference to FIGS. 4A through 4E as a first manner. It should be noted that throughout the drawings from FIGS. 4A through 4E (also through FIGS. 5A–5E, 6A–6E, and 7A–7E), examples are shown in which the direction indicated by the hollow arrow oriented from left to right in these drawings is a passing direction of passersby, and the outdoor gateway 7 is called as "entrance", and the indoor gateway 8 is called as "exit". Also, the sensor 26 provided at the entrance 7 is called as "entrance sensor 26", and the sensor 27 provided at the exit 8 is called as "exit sensor 27".

Figure 4A:
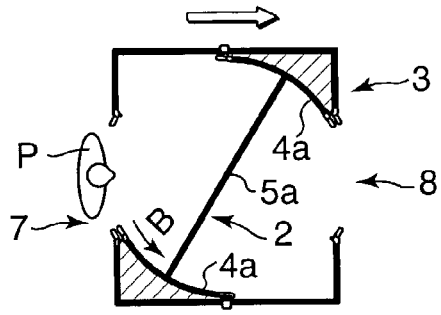

In FIG. 4A, when a passerby approaches the door system 1, the entrance sensor 26 detects the approach. Then, the entrance 7 is opened by swinging the swing door unit 2 in a certain direction with a surface of the swivel panel 5*a* facing the entrance 7 (first gateway).

Specifically, the controller 28 in receipt of the detection signal from the sensor 26 drives the motor 23 forward to travel the geared belt 22 in the direction of arrow B so as to swing the door panel 4*a* to one maximal swing limit as shown in FIG. 4A. Data concerning the swingable range of the swivel panel unit 2 is stored in a memory in the controller 28 in advance. For instance, the swivel panel unit 2 swings leftward and rightward to their respective maximal swing limits by giving a pulse signal corresponding to an angular displacement of the swivel panel unit 2 to the motor 23 or by time-controlling the drive of the motor 23 in accordance with the angular displacement.

When the entrance 7 is opened, a passerby P is allowed to enter the compartment 3. At this point, the partition panel 5*a* separates the compartment 3 into an indoor zone communicating with the inside of the building (indoor-side) and an outdoor zone communicating with the outside of the building (outdoor-side) (see FIG. 4A).

Next, as the passerby P goes forward inside the compartment 3, the output of the detection signal from the entrance sensor 26 is suspended. Then, the controller 28 drives the motor 23 backward to swing back the swivel panel unit 2 in the direction of arrow C.

Figure 4B:
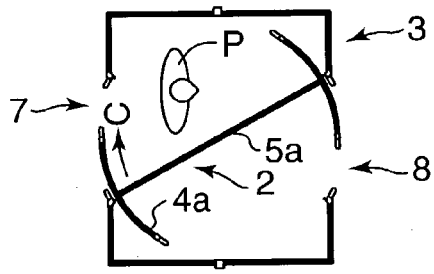

As the swivel panel unit 2 swings back in C-direction, the entrance 7 is gradually closed, and passage for the passerby P is defined in the compartment 3 (see FIG. 4B). When the partition panel 5*a* is substantially aligned with the passing direction of the passerby P, the passerby P is allowed to go forward along the passage in the compartment 3 toward the exit 8 (see FIG. 4C).

Figure 4C:
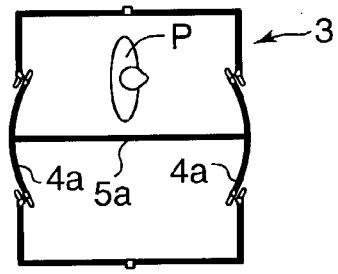
Figure 4D:
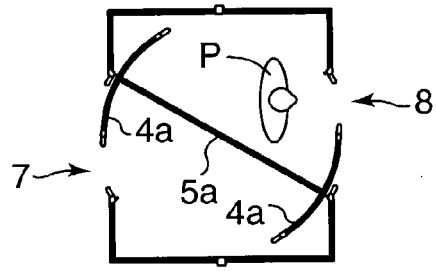

When the swivel panel unit 2 further swings back in C-direction, the exit 8 is gradually opened (see FIG. 4D). When the swivel panel unit 2 swings back to its opposite maximal swing limit, the exit 8 is opened wide to allow the passerby P to go out of the compartment 3 through the exit 8 (see FIG. 4E). At this time, the opposite surface of the partition panel 5*a* faces the entrance 7.

Figure 4E:
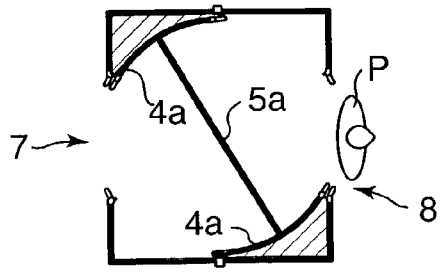
Figure 5A:
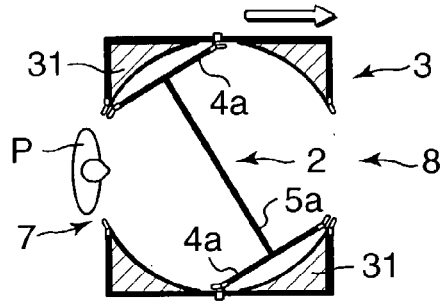
Figure 5B:
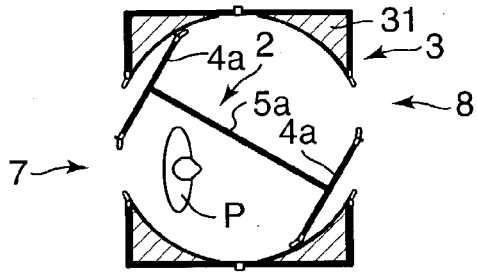
Figure 5C:
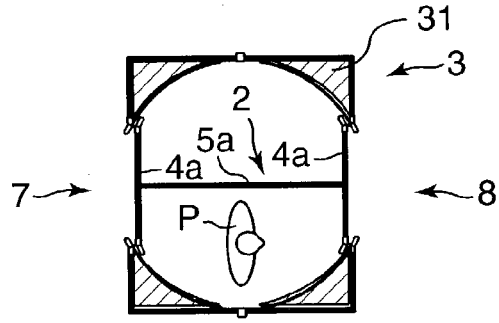
Figure 5D:
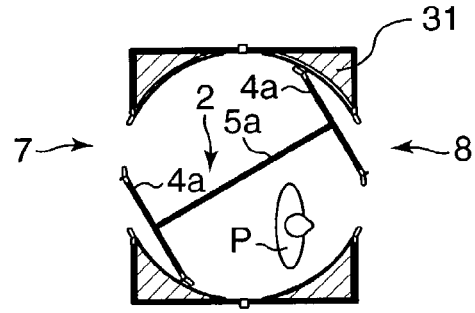
Figure 5E:
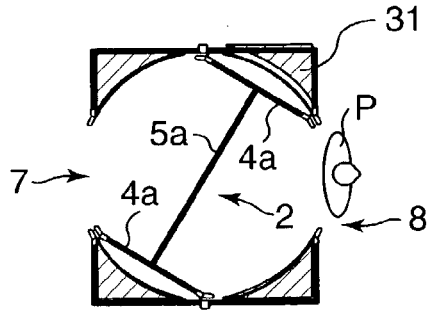

At the timing of FIG. 4E, a next passerby is allowed to enter the compartment 3 through the entrance 7, and is allowed to pass the compartment 3 in the similar manner as mentioned above except that in this case, the passage for the next passerby is defined in the lower half section of the compartment 3 in the drawing of FIG. 4C, whereas the passage for the former passerby is defined in the upper half section of the compartment 3.

In other words, each time the swivel panel unit 2 swings back and forth, passersby P are allowed to go through the compartment 3, passing the upper half section (first section) and the lower half section (second section) alternately.

It is preferable that the door panels 4*a*, 4*a* close the entrance 7 and the exit 8 respectively while the entrance sensor 26 and the exit sensor 27 do not output detection signals. However, if traffic is heavy, it is possible to swing the door panels 4*a*, 4*a* to their respective maximal swing limits to keep the entrance 7 and the exit 8 open wide so that passerby are allowed to pass the compartment 3 through the entrance 7 and the exit 8 all the time.

A second manner of the door system and an operation thereof are described with reference to FIGS. 5A through 5E. Elements in the second manner identical to those in the first manner are denoted at the same reference numerals as the first manner, and a repetitive description thereof is avoided herein. Likewise, elements in third to ninth manners of the invention which are identical to those in the first manner are denoted at the same reference numerals as the first manner.

In the second manner as shown in FIGS. 5A through 5E, generally triangular-shaped columns 31 in plan view serving as spacer blocks are attached to four corners of a compartment 3, respectively. Each spacer block 31 has an arc portion substantially matching with the circumference of a circle corresponding to a track of a door panel 4*a* in swinging motion. With this arrangement, no dead space is defined in a compartment 3, and there is prevented a likelihood that a passerby P may be misguided and entrapped in a dead space corresponding to the spacer block 31 when a swivel panel unit 2 swings back and forth.

FIGS. 5B through 5E shows a sequence of transitions of positional relationship between the swivel panel unit 2 and the spacer blocks 31 corresponding to dead spaces in conjunction with swinging operation of the swivel panel unit 2. Basic operations of opening and closing an entrance 7 and an exit 8 as timed with swinging operations of the swivel panel unit 2 are the same as those shown in FIGS. 4A through 4E.

Figure 6A:
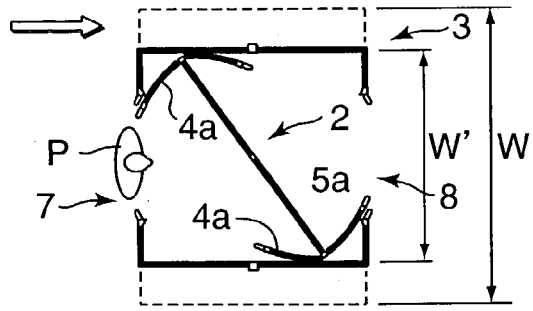
Figure 6B:
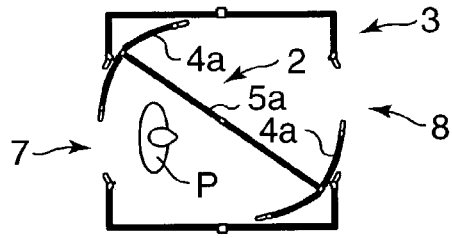
Figure 6C:
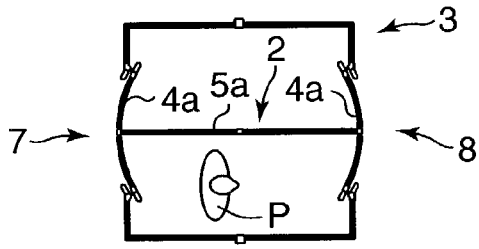
Figure 6D:
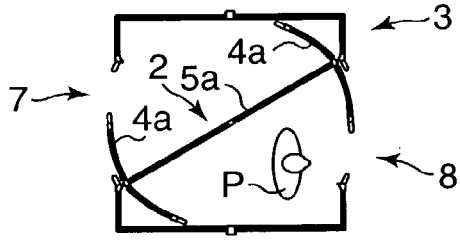
Figure 6E:
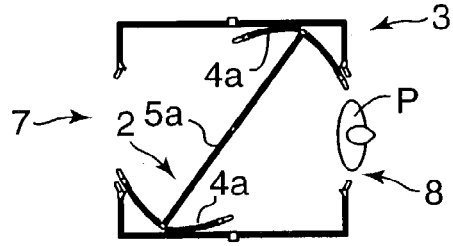
Figure 7A:
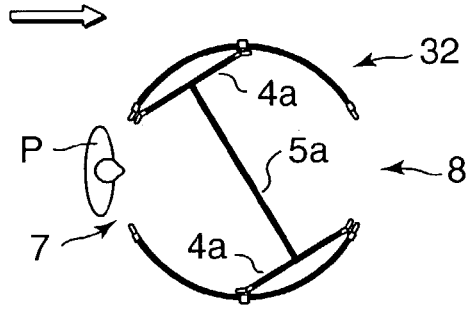
Figure 7B:
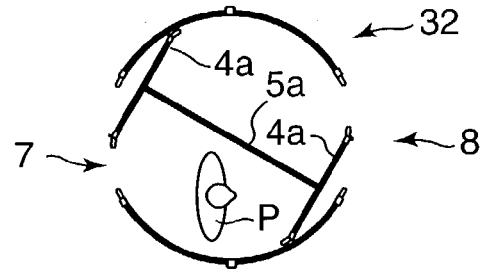
Figure 7C:
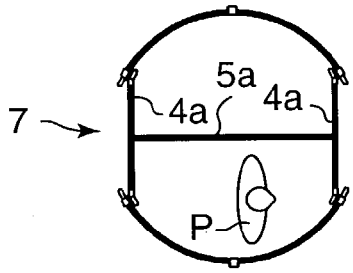
Figure 7D:
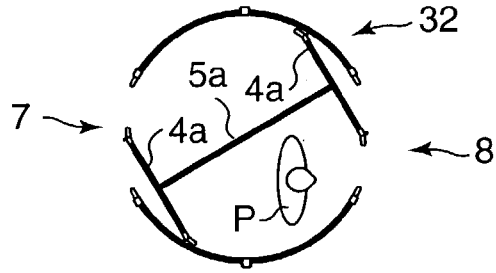
Figure 7E:
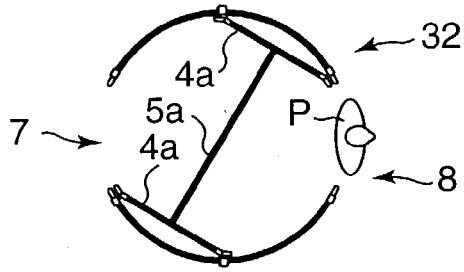

Next, a third manner of the door system and an operation thereof are described with reference to FIGS. 6A through 6E. In FIGS. 6A through 6E, a door panel 4*a* is foldable. Specifically, as shown in FIG. 6A, the door panel 4*a* is foldable inwardly about a supporting part corresponding to a jointed part of the door panel 4*a* and a partition panel 5*a*. As the swivel panel unit 2 swings, the door panel 4*a* is contacted with an inner surface of a compartment 3. Then, the door panel 4*a* is bent inward as being abuttingly guided against the inner surface of the compartment 3, and swings to one of the maximal swing limits.

In the third manner, the width W' of the compartment 3 is made shorter than the width W of the compartment 3 in the first manner. Thus, the door system in accordance with the third manner is installable in a limited space of small dimensions.

FIGS. 6B through 6E show a sequence of folding operations of the door panel 4*a* as timed with swinging operations of the swivel panel unit 2. Basic operations of opening and closing an entrance 7 and an exit 8 as timed with the swinging operations of the swivel panel unit 2 are the same as those shown in FIGS. 4B through 4E.

A fourth manner of the door system and an operation thereof are described with reference to FIGS. 7A through 7E. In the fourth manner, by providing a pair of opposing walls constituting a compartment 32 each having an arc shape in plan view, an entrance 7 and an exit 8 opposing to each other are defined between the walls.

In the above arrangement, no dead space is defined in the compartment 32. In the fourth manner, there is no necessity of providing spacer blocks 31 as shown in the second manner in FIGS. 5A through 5E, and the size of the compartment 32 is reduced.

FIGS. 7B through 7E show a sequence of transitions of positional relationship between a door panel 4*a* and the compartment 32 in conjunction with swinging operations of a swivel panel unit 2. Basic operations of opening and closing an entrance 7 and an exit 8 as timed with the swinging operations of the swivel panel unit 2 are the same as those shown in FIGS. 4B through 4E.

In the fourth manner shown in FIGS. 7A through 7E, the door panel 4*a* has a flat plane. Alternatively, the door panel 4*a* may have a curved plane in conformance with the configuration of the compartment 32 (opposite walls).

Figure 8:
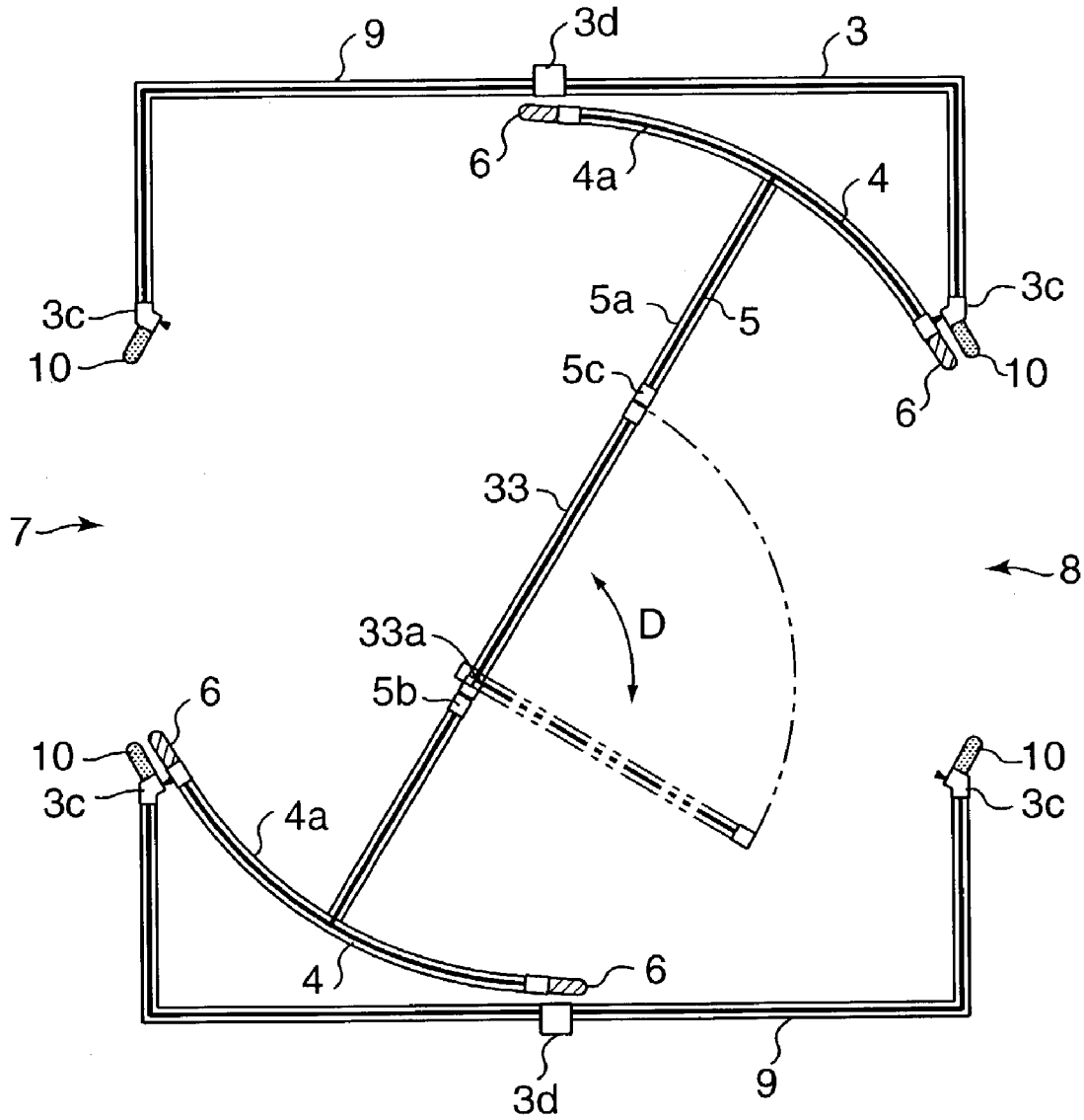
FIG. 8 is a plan view showing an operation of the door system of a fifth embodiment.

Next, a fifth manner of the door system and an operation thereof are described with reference to FIG. 8. In FIG. 8, the door system additionally incorporates a sub door panel 33 at an intermediate part of a swivel panel (partition panel) 5*a*. The sub door panel 33 is manually opened and closed.

Specifically, the partition panel 5*a* includes two vertical posts 5*b*, 5*c* extending vertically in parallel with each other and spaced away from each other with a certain distance. An opening is defined in the partition panel 5*a* between the two vertical posts 5*b*, 5*c*.

The sub door panel 33 is fitted in the opening and is hinged on an upper hinge 33*a* and a lower hinge 33*b* (in FIG. 8, only the upper hinge 33*a* is illustrated) mounted on an upper joint frame 2*b* and a lower joint frame 2*d*, respectively. The sub door panel 33 is opened and closed in the directions of arrows D. By opening the sub door panel 33 in emergency, an evacuation passage in emergency is defined in the partition panel 5*a*. Further, an elongated article is easily transportable by opening the sub door panel 33 of the partition panel 5*a*.

It should be appreciated that the sub door panel 33 in the fifth manner is also applicable to the first, second, and third manners shown in FIGS. 1, 4A through 4E, 5A through 5E, and 6A through 6E.

Further, it is effective to attach an arrow mark on the surfaces of the partition panel 5*a* to notify a passerby of a passing direction (toward entrance or exit). With this arrangement, a passerby is securely instructed of the direction he or she is to be guided as timed with swinging operation of the swivel panel unit 2. Unlike the revolving door in which a plurality of door panels are rotated in a fixed direction, the swivel panel unit in the door system swings back and forth. Accordingly, the arrow mark attached to the surfaces of the partition panel 5*a* securely guides passersby along the direction to pass.

Next, a sixth manner of the door system and an operation thereof are described with reference to FIGS. 9A through 9E. Similar to the swivel panel unit 2 in FIG. 1, a swivel panel unit 2 in the sixth manner is constructed in such a manner that curved door panels 4*a*, 4*a* are provided at opposite ends of a swivel panel (partition panel) 5*a*. The swivel panel unit 2 in the sixth manner alternately swings back and forth clockwise and counterclockwise about an axis of rotation R.A. in a compartment 40.

The compartment 40 has a rectangular shape in plan view, and an outdoor gateway 41 and an indoor gateway 42 are defined along longer sides of the rectangular compartment 40, respectively, as opposed to each other.

In FIGS. 9A through 9E, the region indicated by the arrows E shows an area within which the swivel panel unit 2 swings in the compartment 40. The region E is a passage area where passersby normally pass the compartment 40. By allowing the swivel panel unit 2 to swing back and forth within the passage area E, the door panels 4*a* are securely contacted with the inner surfaces of the compartment 40, thus securing draught eliminating effect.

The regions indicated by $F_1$ and $F_2$ are stay areas defined in the compartment 40, each communicating with the passage area E. Passersby are allowed to stay in the stay areas $F_1$ and $F_2$ while passing the compartment 40.

For instance, let it be assumed that a passerby has lost timing of passing through the outdoor gateway 41 when going from the indoor to the outdoor (in the direction shown by arrow G). In such an occasion, the passerby is allowed to stay in the stay area $F_1$ temporarily. Likewise, a passerby who has lost timing of passing through the indoor gateway 42 when going from the outdoor to the indoor is allowed to stay in the stay area $F_2$. In any case, a passerby who has lost timing of going through the outdoor gateway 41 (indoor gateway 42) is allowed to stay in the stay area $F_1$ ($F_2$) until a next timing of opening the outdoor gateway 41 (indoor gateway 42), and passes the compartment 40 without fail.

Further, the stay areas $F_1$ and $F_2$ do not overlap the passage area E corresponding to a swinging area of the swivel panel unit 2. Accordingly, in the case where the door system in accordance with the sixth manner is installed in an entrance hall of an apartment or an equivalent facility, a mailbox 43 may be provided in the stay area $F_2$, for example.

Specifically, a passerby coming from the outdoor into the compartment 40 is allowed to check out the mailbox 43 and take out a mail or the like through the mailbox 43 while staying in the stay area $F_2$ without being obstructed by the swivel panel unit 2 in motion. After taking out the mail or the like through the mailbox 43, the passerby is allowed to return to the passage area E without being obstructed by the swivel panel unit 2, and is allowed to enter the indoor through the indoor gateway 42 at a next timing when the door panel 4*a* opens the indoor gateway 42.

Next, an operation of the door system in the sixth manner is described by taking an example where a passerby passes the compartment 40 from the outdoor through the outdoor gateway 41 and enters the indoor through the indoor gateway 42 with reference to FIGS. 9A through 9E.

Figure 9A:
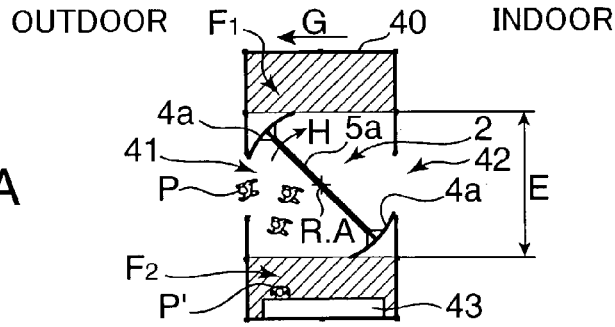

In FIG. 9A, a passerby P is allowed to enter the compartment 40 at a timing at which the swivel panel unit 2 swings in the direction of arrow H to open the outdoor gateway 41.

Figure 9B:
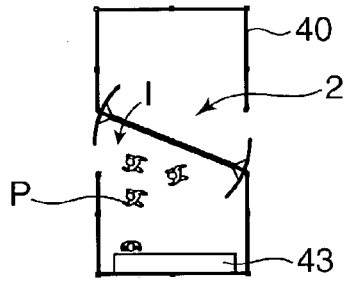

Then, as shown in FIG. 9B, the passerby P is allowed to go forward toward the indoor gateway 42 at a timing at which the swivel panel unit 2 swings back in the direction of arrow I.

Figure 9C:
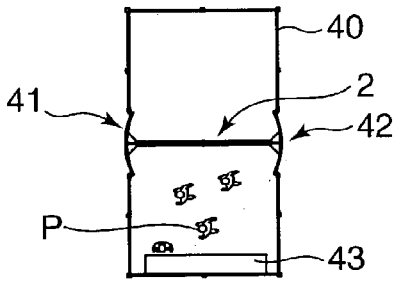

As shown in FIG. 9C, in the course of swinging back in the direction of arrow I, the door panels 4*a*, 4*a* of the swivel panel unit 2 temporarily close the outdoor gateway 41 and the indoor gateway 42, respectively. Thus, the draught eliminating effect of the door system is securely maintained. While the door panels 4*a*, 4*a* of the swivel panel unit 2 close the outdoor gateway 41 and the indoor gateway 42, the passerby P is allowed to go further forward toward the indoor gateway 42.

Figure 9D:
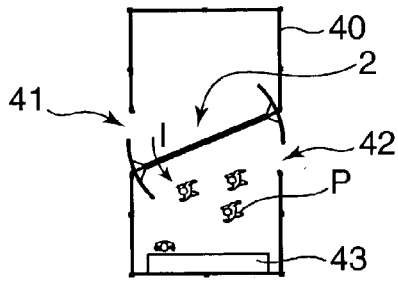

When the swivel panel unit 2 further swings in the direction of arrow I as shown in FIG. 9D, the indoor gateway 42 is gradually opened. When the swivel panel unit 2 completely opens the indoor gateway 42 as shown in FIG. 9E, the passerby P is allowed to enter the indoor through the indoor gateway 42.

At a timing shown in FIG. 9A at which the swivel panel unit 2 swings in the direction of arrow H, a passerby P' who wants to check out the mailbox 43 is allowed enter the stay area $F_2$ without obstructing the passage of the other passersby and stay in the stay area $F_2$ as long as he or she wants.

Figure 9E:
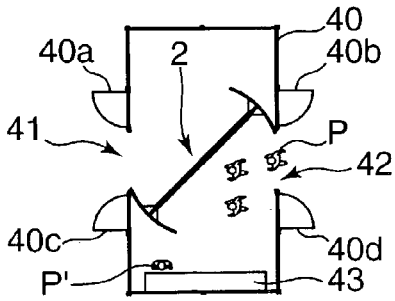
Figure 10A:
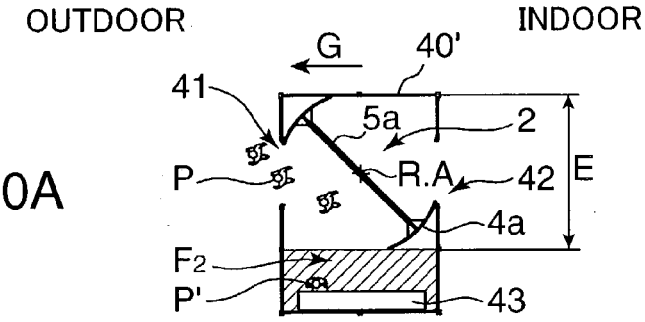
Figure 10B:
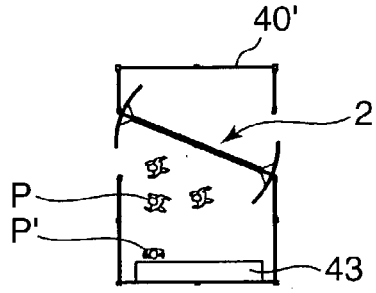
Figure 10C:
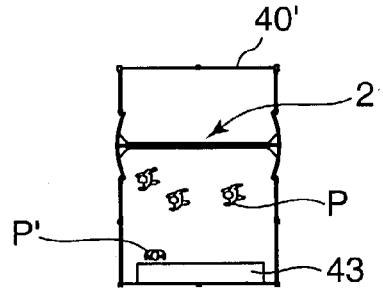
Figure 10D:
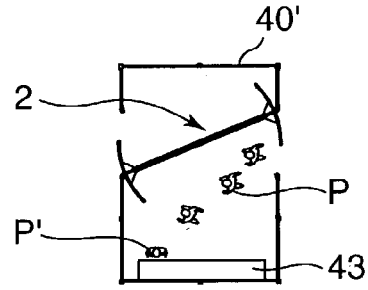
Figure 10E:
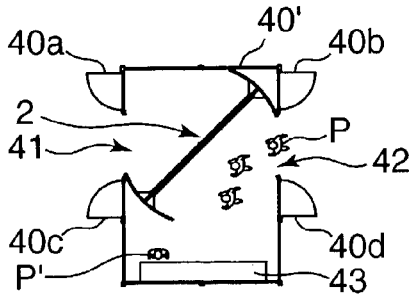

In FIG. 9E, reference numerals 40*a*, 40*b* denote emergency doors provided at the opposite sides of the compartment 40 in the passing direction, on one side with respect to the outdoor gateway 41 (indoor gateway 42). Likewise, reference numerals 40*c*, 40*d* denote emergency doors provided at the opposite sides of the compartment 40 in the passing direction, on the side opposite to the one side with respect to the outdoor gateway 41 (indoor gateway 42). In the case where necessity arises that an elongated article is to be transported or in case of emergency, the emergency doors 40*a* and 40*b* (40*c* and 40*d*) are manually opened from the inside of the compartment 40.

FIGS. 10A through 10E are diagrams showing a modification of the sixth manner shown in FIGS. 9A through 9E. It should be appreciated that like elements in the modification are denoted with like reference numerals, and a repeated description thereof is avoided.

In FIGS. 9A through 9E, the stay areas $F_1$, $F_2$ are provided on the opposite sides of the compartment 40 with respect to the partition panel 5*a* of the swivel panel unit 2. Alternatively, in the modification shown in FIGS. 10A through 10E, only one stay area (in this case, a stay area $F_2$) is provided on one of the opposite sides of a compartment 40'.

In an environment where traffic from indoor to outdoor (direction shown by arrow G) is light, whereas traffic from outdoor to indoor is heavy, it is possible to provide only one stay area $F_2$ in the compartment 40'. In such a modification, the dimensions of the compartment 40' is reduced.

Also, in the modification, it may be possible to provide a mailbox 43 in the stay area $F_2$. With such a modification, as shown in FIGS. 10A through 10E, a passerby is allowed to pass the compartment 40' from outdoor to indoor (in a direction opposite to G-direction) without difficulty, in the similar manner as in FIGS. 9A through 9E, on the side where the stay area $F_2$ is provided. Likewise, a passerby is allowed to pass the compartment 40' from indoor to outdoor in G-direction, on the side where the stay area $F_2$ is not provided.

In the above modification, a passerby P' who wants to check out the mailbox 43 while passing the compartment 40' from outdoor to indoor is allowed to enter the stay area $F_2$ without obstructing passage of the other passersby P and is allowed to stay in the stay area $F_2$ as long as he or she wants.

Figure 11A:
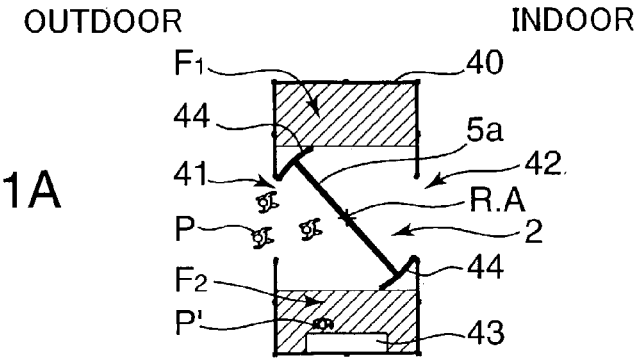
Figure 11B:
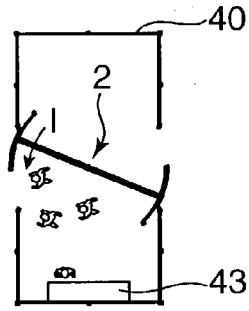
Figure 11C:
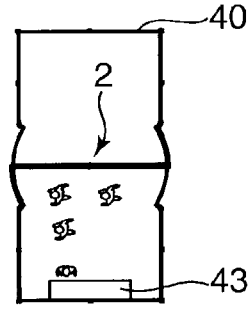
Figure 11D:
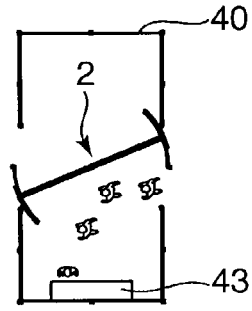
Figure 11E:
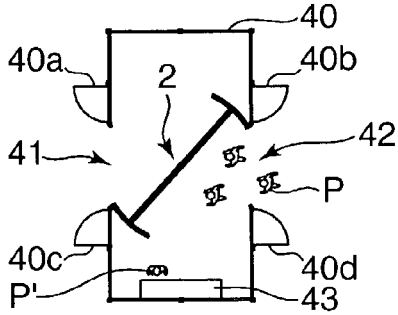

Next, a seventh manner of the invention is described with reference to FIGS. 11A through 11E. The seventh manner is different from the sixth manner in the aspect of the arrangement of the door panel. Specifically, door panels 44, 44 are provided in the seventh manner in place of the door panels 4*a*, 4*a* in the sixth manner. Each door panel 44 has a two-layered construction in such a manner that one of the layers is selectively extendable and retractable relative to the other one of the layers in a sideway direction. In the case where the door panels 44, 44 open an outdoor gateway 41 and an indoor gateway 42 respectively, as shown in FIG. 11A, the door panel 44 (44) is brought to a retracted state. On the other hand, in the case where the door panels 44, 44 close the respective outdoor gateway 41 and the indoor gateway 42, as shown in FIG. 11C, the door panel 44 (44) is brought to an extended state.

More specifically, when the door panel 44 swings in a certain direction to one of its maximal swing limits (namely, is brought to a retracted state), the entirety of the door panel 44 is encased in a compartment 40 with a minimal width, as shown in FIG. 11A. Then, as the door panel 44 swings back in the direction shown by arrow I about the axis of rotation R.A., the door panel 44 is gradually shifted from the retracted state toward an extended state (see FIG. 11B). When the door panel 44 (44) closes the outdoor gateway 41 (indoor gateway 42), the door panel 44 (44) is brought to the extended state having a maximal width (see FIG. 11C). Then, as the door panel 44 (44) swings further in I-direction, the outdoor gateway 41 (indoor gateway 42) is gradually opened, and the door panel 44 (44) is shifted from the extended state toward a retracted state (see FIG. 11D). When the door panel 44 (44) swings further in I-direction to the other one of its maximal swing limits and is encased within the compartment 40 with the outdoor gateway 41 (indoor gateway 42) opening wide (see FIG. 11E), the door panel 44 (44) is brought to the retracted state having the minimal width.

In the above arrangement, the swivel panel unit 2 is swingable with a minimal angular displacement of a swivel panel (partition panel) 5*a* of the swivel panel unit 2. Thereby, a maximal opening width is secured with respect to the outdoor gateway 41 and the indoor gateway 42, while minimizing the dead space of the compartment 40.

Next, an eighth manner of the invention is described with reference to FIGS. 12A through 12E. In the eighth manner, a swivel panel unit 2 comprises a swivel panel (partition panel) 50 and a pair of arc-shaped door panels 51, 51 provided at the opposite ends of the swivel panel 50. The door panel 51 (51) swings clockwise and counterclockwise about the axis of rotation R.A. alternately in a region outside of a compartment 52.

Specifically, the compartment 52 has a rectangular shape in plan view. An outdoor gateway 53 and an indoor gateway 54 are defined opposingly along the longer sides of the compartment 52, respectively. Lateral end portions 52*a*, 52*b* of the compartment 52 defining the outdoor gateway 53 are spaced apart from each other with a sufficient distance to secure a large opening width of the outdoor gateway 53. The door panel 51 of the swivel panel unit 2 swings within the lateral end portions 52*a*, 52*b* by setting the lateral end portions 52*a*, 52*b* as the maximal swing limits of the door panel 51.

By bulging the door panel 51 out of a front surface 52' of the compartment 52 (see FIG. 12C), the door panel 51 is selectively extendable and retractable while reducing the radius of rotation of the swivel panel 50. The extendable and retractable mechanism of the door panel 51 will be described later.

Figure 12A:
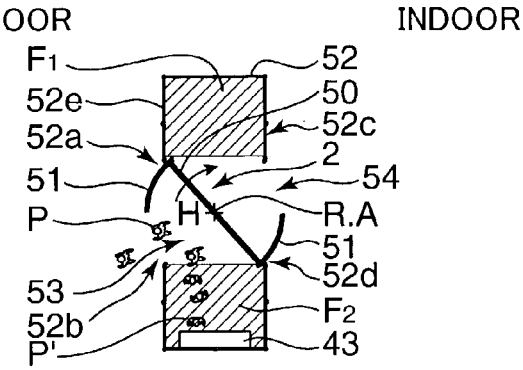

In FIGS. 12A through 12E, reference numerals 52*e* through 52*h* denote emergency doors, respectively. Now, an operation of the eighth manner is described by taking an example where a passerby passes the compartment 52 from outdoor to indoor. When operation of the door system is initiated, as shown in FIG. 12A, the swivel panel 50 swings in the direction of arrow H, and the swinging operation is suspended when a lead end of the door panel 51 in the swinging direction is abutted against the lateral end portion 52*a* of the compartment 52 (namely, when the door panel 51 swings to one of its maximal swing limits). Upon reaching the one maximal swing limit, the door panel 51 is brought to a retracted state where the width of the door panel 51 is minimized, and the outdoor gateway 53 is opened wide. Thus, a passerby P is allowed to enter the compartment 52 through the outdoor gateway 53.

Figure 12B:
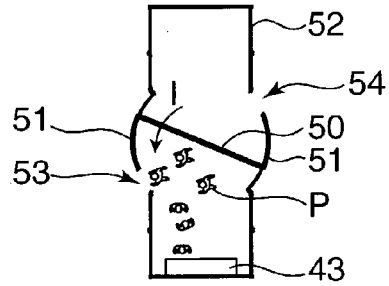

Next, when the swivel panel 50 swings back in the direction of arrow I, as shown in FIG. 12B, the door panel 51 is gradually shifted from the retracted state toward an extended state. As the door panel 51 is gradually shifted toward the extended state, the outdoor gateway 53 is closed.

Figure 12C:
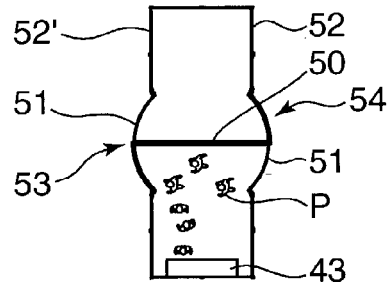

FIG. 12C illustrates a state where the outdoor gateway 53 and the indoor gateway 54 are completely closed by the door panels 51, 51, respectively. While the outdoor gateway 53 and the indoor gateway 54 are closed, the passerby P is allowed to go forward toward the indoor gateway 54.

Figure 12D:
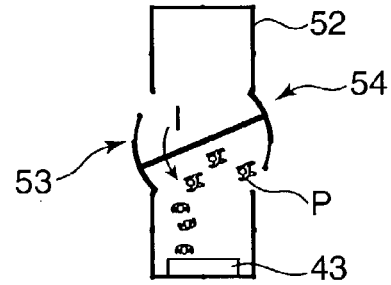

Next, as shown in FIG. 12D, as the swivel panel 50 swings further in I-direction, the door panel 51 is shifted from the extended state toward a retracted state, and the indoor gateway 54 is gradually opened.

Figure 12E:
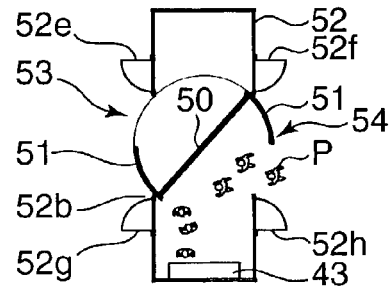

When the swivel panel 50 swings to the other one of the maximal swing limits, as shown in FIG. 12E, namely, when a lead end of the door panel 51 in the swinging direction is abutted against the lateral end portion 52*b* of the compartment 52, the door panel 51 is shifted to the retracted state, and the passerby P is allowed to enter the indoor through the indoor gateway 54.

In the above arrangement, a maximal opening width is secured with respect to the outdoor gateway 53 and the indoor gateway 54 without the likelihood that swinging operation of the door panels 50 is obstructed by an inner surface of the compartment 52. With this arrangement, a passerby is allowed to pass the compartment 52 without defining dead space in the compartment 52.

Further, since a large radius of curvature of the door panel 50 is secured in the above arrangement, a large passage area is secured within the compartment 52.

A ninth manner of the invention is described with reference to FIGS. 13A through 13E. In the ninth manner, a plurality of swivel panel units 2 (in this manner, two swivel panel units 2) are arranged in a compartment 52.

In order to provide a number of swivel panel units 2, the compartment 52 has a rectangular shape such that the sides of the compartment 52 orthogonal to the passing direction are long. Extension walls 52*g* parallel to the respective longer sides of the compartment 52 are provided between the swivel panel units 2 to extend the longer sides of the compartment 52.

Figure 13A:
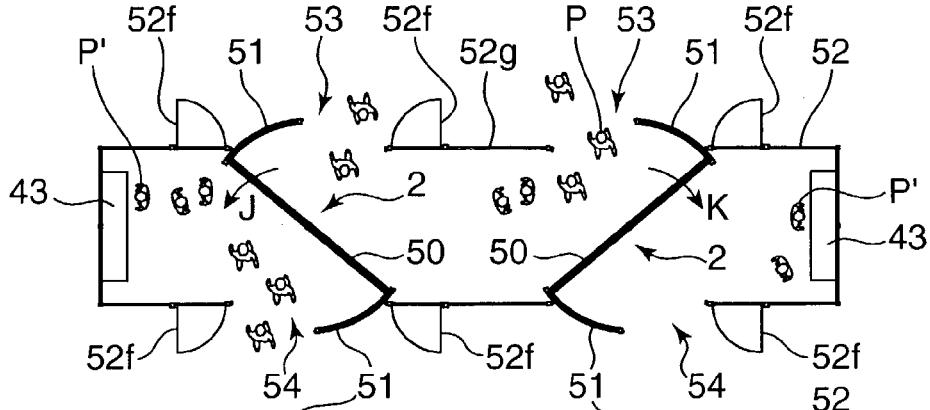

The swivel panel units 2, 2 are arranged side by side in the compartment 52 in such a manner that the swivel panel units 2, 2 are opened and closed symmetrically to each other with respect to the passing direction. For instance, as shown in FIG. 13A, when the left-side swivel panel unit 2 swings in the direction of arrow J, the right-side swivel panel unit 2 swings in the direction of arrow K, which is opposite to the direction J. With this arrangement, each time door panels 51, 51 of the left-side swivel panel unit 2 (right-side swivel panel unit 2) swing back and forth, communication of an outdoor zone communicating with an outdoor gateway 53 and an indoor zone communicating with an indoor gateway 54 of the left-side swivel panel unit 2 (right-side swivel panel unit 2) is blocked by a partition panel of the left-side swivel panel unit 2 (right-side swivel panel unit 2). Thus, draught eliminating effect of the door system is secured.

In the ninth manner, a mailbox 43 may be arranged at the opposite end areas of the compartment 52 in the extending direction thereof. With this arrangement, measures for coping with increase of traffic is provided, and a sufficient evacuation space is secured. Further, in the case of installing the door system in accordance with the ninth manner in an entrance hall of an apartment or an equivalent facility, a space for providing a number of mailboxes corresponding to the number of residents is secured.

Figure 13B:
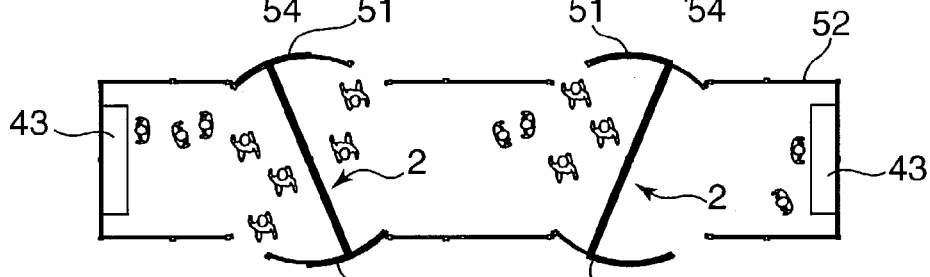
Figure 13C:
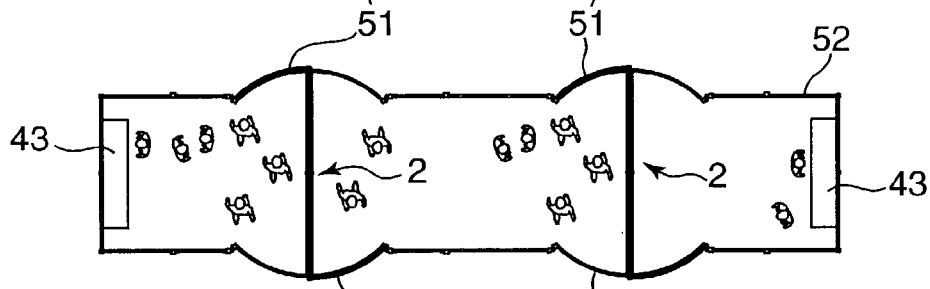
Figure 13D:
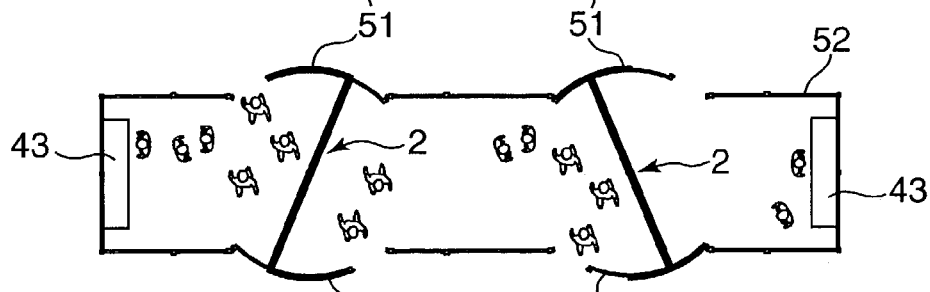
Figure 13E:
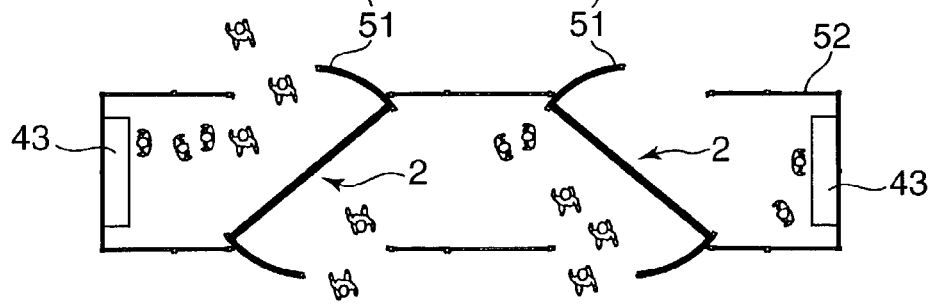

FIG. 13B shows a state that the swivel panel units 2, 2 swing in such a direction as to swing the door panels 51, 51 on the side of the outdoor gateways 53, 53 away from each other and swing the door panels 51, 51 on the side of the indoor gateways 54, 54 toward each other with each door panel 51 being shifted toward an extended state. FIG. 13C shows a state that each door panel 51 is brought to the extended state, and the outdoor gateways 53, 53 and the indoor gateways 54, 54 are completely closed. FIG. 13D shows a state that the outdoor-side door panels 51, 51 are moved toward each other and the indoor-side swing door panels 51, 51 are moved away from each other with each door panel 51 being shifted toward a retracted state. FIG. 13E shows a state that the outdoor-side door panels 51, 51 swing toward each other at their respective maximal swing limits and the indoor-side swing door panels 51, 51 swing away from each other at their respective maximal swing limits with each door panel 51 being completely brought to the retracted state. Thereby, the outdoor gateways 53, 53 and the indoor gateways 54, 54 are completely opened wide.

Figure 14:
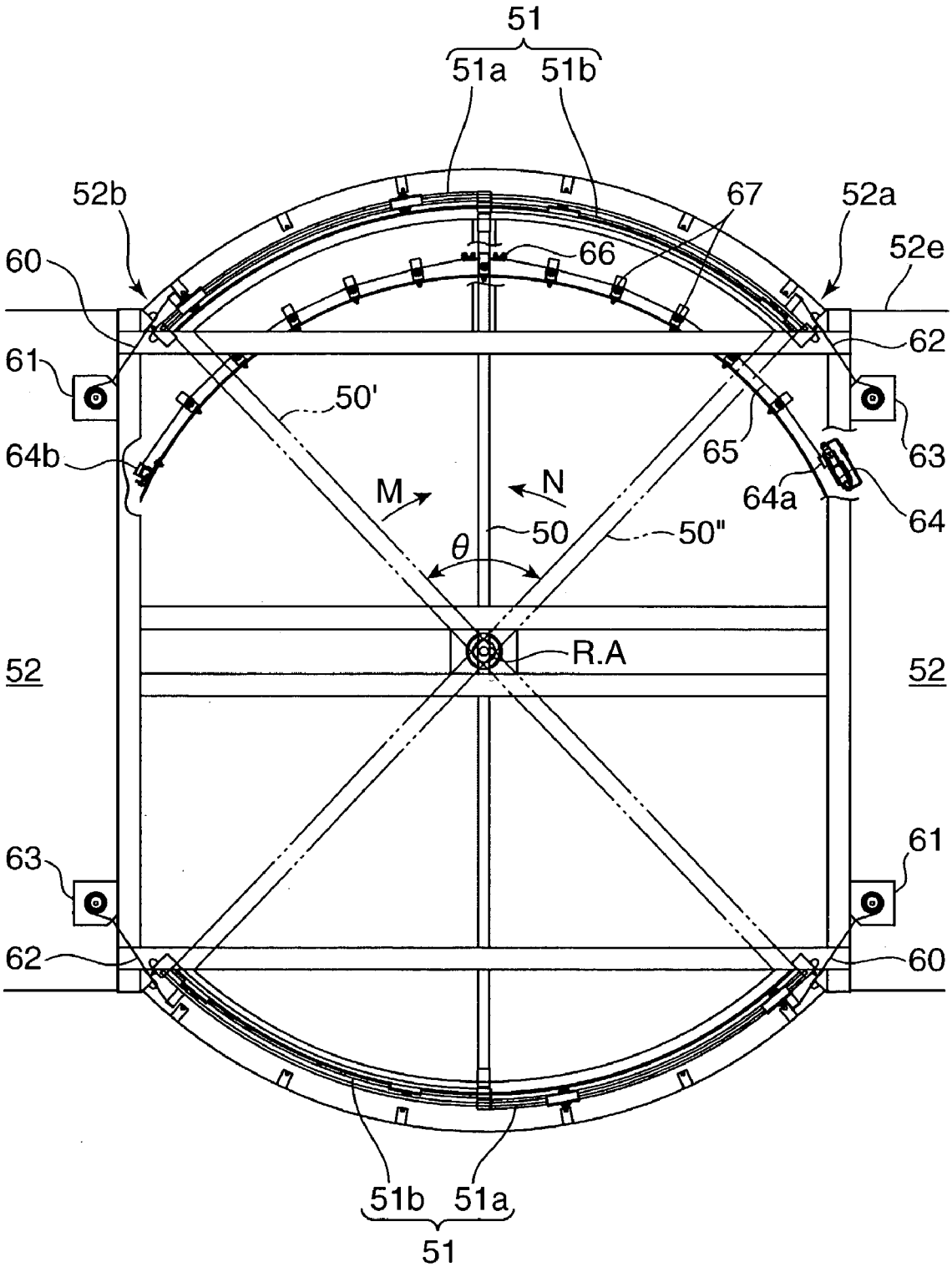
FIG. 14 is a plan view showing an arrangement of a swivel panel unit for the eighth embodiment as shown in FIGS. 12A through 12E.
Figure 15:
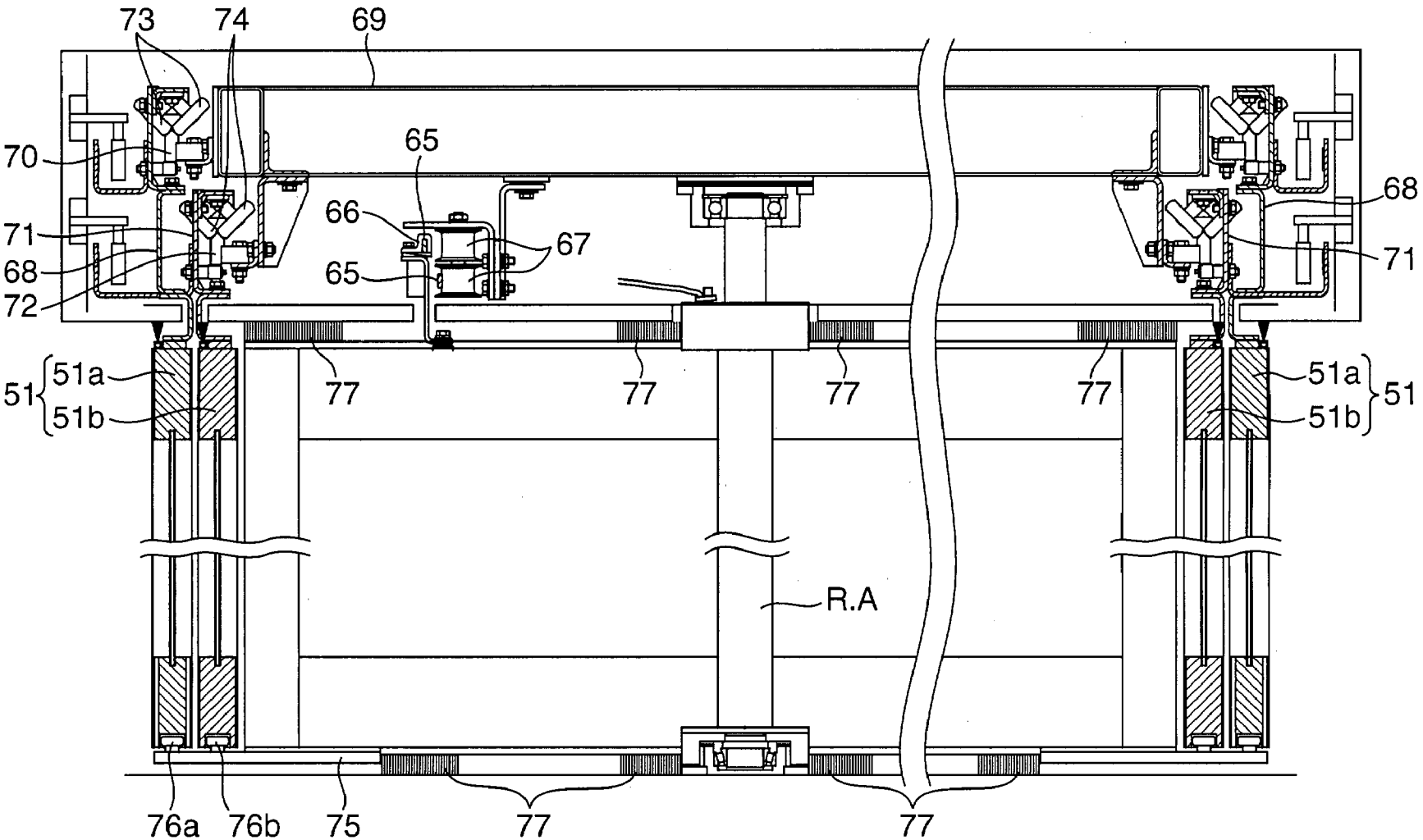
FIG. 15 is a front view of a driving mechanism for swinging the swivel panel unit for the eighth embodiment as shown in FIGS. 12A through 12E.

FIG. 14 is a plan view showing an arrangement of the swivel panel unit 2 in the eighth manner, and FIG. 15 is a front view of a driving mechanism for swinging the swivel panel unit 2 in the eighth manner.

In FIG. 14, the door panels 51, 51 are provided at the opposite ends of the swivel panel 50 to open and close the corresponding gateway 53 (54). Now, the arrangement of the door panel 51 is described by taking an example of one door panel (in FIG. 14, the upper door panel 51 is shown). The door panel 51 has a multi-layered construction including an arc-shaped outer panel 51*a* and an arc-shaped inner panel 51*b*. A left end portion of the outer panel 51*a* in FIG. 14 is connected to a wire 60. The wire 60 is wound around a winding device 61 arranged at the left side in FIG. 14 to constantly apply a tension force to the wire 60 in a certain direction. Likewise, a right end portion of the inner panel 51*b* in FIG. 14 is connected to a wire 62. The wire 62 is wound around a winding device 63 arranged at the right side in FIG. 14 to constantly apply a tension force to the wire 62.

The swivel panel 50 swings between a right-side boundary 50' and a left-side boundary 50" each indicated by the two-dashed line within a rotating angle θ°. An endless belt 65 wound around a drive pulley 64*a* and a driven pulley 64*b* is circulated in an arc configuration in response to forward and backward rotations of a drive motor 64. As the endless belt 65 is driven, the swivel panel 50 which is fixed to the endless belt 65 by clamps 66, 66 swings back and forth about an axis of rotation R.A. within the right-side boundary 50' and the left-side boundary 50". Reference numerals 67 denote guide rollers for guiding the endless belt 65.

When the drive motor 64 is rotated forward, the swivel panel 50 swings in the direction of arrow M. While the swivel panel 50 swings in M-direction, the swivel panel 50 and the inner panel 51*b* are engaged with each other. Thus, the inner panel 51*b* in engagement with the swivel panel 50 is drawn out of the outer panel 51*a* as the swivel panel 50 swings in M-direction.

When the swivel panel 50 swings straight forward (upward in FIG. 14) as shown by the solid line, the door panel 51 is shifted to an extended state where the inner panel 51*b* is completely drawn out of the outer panel 51*a*. At this point, the swivel panel 50 is disengaged from the inner panel 51*b*, and in turn, is engaged with the outer panel 51*a*. When the swivel panel 50 further swings in M-direction, the outer panel 51*a* in engagement with the swivel panel 50 is retracted inside of the inner panel 51*b* in an overlapped state as the swivel panel 50 swings in M-direction. Thus, the door panel 51 is shifted to a retracted state where the inner panel 51*b* and the outer panel 51*a* are substantially overlapped to each other.

On the other hand, when the drive motor 64 is rotated backward, the swivel panel 50 swings back in the direction of arrow N from the right-side boundary 50" toward the left-side boundary 50'. In this way, as the swivel panel 50 swings leftward and rightward (back and forth), the corresponding gateway is opened and closed.

In FIG. 15, the outer panel 51*a* travels along a rail 70 which is suspended from a ceiling frame 69 via hangers 68, and the inner panel 51*b* travels along a rail 72 which is suspended from the ceiling frame 69 via hangers 71. Reference numerals 73, 74 each denotes a pair of rollers which constitute a V-shape in plan view in FIG. 15. The pairs of rollers 73 and 74 roll along the rails 70 and 72 so as to position the outer panel 51*a* and the inner panel 51*b* at a desired position on the rails 70 and 72, respectively.

Lower parts of the outer panel 51*a* and the inner panel 51*b* are guided by rollers 76*a* and 76*b* which are arranged on a lower plate 75 of the swivel panel 50. Reference numeral 77 denotes a brush for enhancing air-tightness of the compartment 52. In FIG. 15, part of the brush 77 is shown.

As described above, an inventive door system is provided with a compartment formed with a first gateway and a second gateway opposed to the first gateway. The door system is further provided with a barrier apparatus or barrier means for opening and closing the first gateway and the second gateway, and keeping the opened first gateway and the opened second gateway from communicating with each other directly.

The barrier apparatus or barrier means includes a swivel panel which swings back and forth within an angular displacement of 180° or less, the swivel panel selectively swinging in such a direction that one surface of the swivel panel faces the first gateway when the swivel panel swings in one direction, whereas the opposite surface of the swivel panel faces the first gateway when the swivel panel swings in the opposite direction, a pair of door panels provided at the opposite ends of the swivel panel, the door panels operatively opening and closing the first gateway and the second gateway respectively at the same timing while keeping contact with the compartment, and a driving mechanism which operatively swings the swivel panel back and forth.

In the above arrangement, when the swivel panel swings in one direction, the first gateway and the second gateway are opened to allow a passerby to enter the compartment. At this time, the swivel panel renders the compartment to a first state where the swivel panel separates the compartment into an indoor zone communicating with the indoor and an outdoor zone communicating with the outdoor. While the compartment is in the first state, communication between the indoor zone and the outdoor zone is blocked by the swivel panel.

Subsequently, on the way of swinging the swivel panel in the other direction, the door panel closes the first gateway (e.g., gateway communicating with the outdoor) with the swivel panel being aligned in a direction of connecting the first gateway and the second gateway. While the first gateway and the second gateway are closed, the compartment is rendered to a second state where the compartment is separated into two sections by the swivel panel, and communication between the two sections is blocked by the swivel panel. Then, the passerby who entered the compartment through the first gateway is allowed to go forward toward the second gateway (e.g., gateway communicating with the indoor) through the first (second) section with draught eliminating effect being secured.

When the swivel panel further swings in the other direction, the second gateway (indoor gateway) is opened and the passerby is allowed to pass through the indoor gateway out of the compartment. At this time, the swivel panel renders the compartment to the first state where the swivel panel separates the compartment into an indoor zone communicating with the indoor and an outdoor zone communicating with the outdoor.

In this way, in response to swinging operation of the swivel panel, the compartment is alternately changed to the first state and the second state. At a timing of opening the first gateway and the second gateway, a passerby is allowed to enter the compartment through the first gateway and the second gateway.

Preferably, the door panel may have an arc shape in plan view. In this construction, the dimension of the compartment in the passing direction is increased.

Preferably, the compartment may have a quadrangular shape in plan view, and a spacer block may be provided at each corner portion of the compartment to fill a space defined by the inner surface of the compartment and the door panel. With this arrangement, a passerby is safely passed without likelihood that he or she may be misguided and entrapped in the space corresponding to one of the four corner portions of the compartment.

Preferably, the compartment may have a rectangular shape in plan view having a longer side in a direction of passing passersby, and the door panel may be foldable about a supporting point corresponding to a joint portion of jointing the door panel and the swivel panel while the door panel is abuttingly guided against the inner surface on the longer side of the compartment in opening the gateway. With this arrangement, the size of the compartment in a direction orthogonal to the passing direction is reduced, and the dimensions of the door system is reduced accordingly.

Preferably, the door panel may have an arc shape in plan view, and a multi-layered construction to be selectively extendable and retractable in a direction of opening and closing the gateway in such a manner that the door panel is brought to a retracted state while the door panel opens the gateway, and is brought to an extended state while the door panel closes the gateway. With this arrangement, the angular displacement of the swivel panel is reduced, and the dead space in the compartment is reduced accordingly. Furthermore, since the door panel is a multi-layered construction to be selectively extendable and retractable in the widthwise direction of the door panel, a relatively wide gateway is closable by the door panel.

Preferably, the swivel panel includes a sub door which is manually opened and closed. With this arrangement, an evacuation passage in emergency is secured. Further, an elongated article is easily transported by opening the sub door.

Preferably, the compartment may be provided with a stay area at least on one side of the compartment relative to the swivel panel to allow a passerby to stay. The stay area is communicated with a passage area for passing the passerby in the compartment. With this arrangement, in the case where the passerby fails to pass the compartment as timed with the swinging operation of the swivel panel, he or she is allowed to stay in the stay area. Thus, the passerby is allowed to pass the door system safely without causing interference in traffic.

It may be preferable that the width of the door panel corresponds to a transverse dimension of the gateway, the transverse dimension of the gateway is smaller than a predetermined value to thereby ensure a reduced swinging amount of the door panel into the compartment. In other words, the door panel may be so configured as to conform with the transverse dimension of the gateway in such a manner that the swinging amount of the door panel into the compartment is reduced. In this arrangement, by setting the transverse dimension of the gateway at such a size to allow a wheel-chaired person to pass through the gateway, for example, the width of the door panel is narrowed in correspondence with the transverse dimension of the gateway. Consequently, the swinging amount of the door panel into the compartment is reduced, and the dead space in the compartment is reduced accordingly. As a result, the size of the compartment is reduced.

Preferably, the door panel may have an arc shape in plan view and a multi-layered construction to be selectively extendable and retractable in a direction of opening and closing the gateway in such a manner that the door panel is brought to a retracted state while the door panel opens the gateway and is brought to an extended state while the door panel closes the gateway. With this arrangement, a maximal opening width is secured with respect to the gateways, while minimizing the dead space of the compartment.

Preferably, the compartment may be provided with a stay area at least on one side of the compartment relative to the swivel panel to allow a passerby to stay with the stay area being communicated with a passage area for passing the passerby in the compartment. The door panel may have an arc shape in plan view and a multi-layered construction to be selectively extendable and retractable in a direction of opening and closing the gateway. The door panel may swing back and forth within an angular displacement defined by a transverse dimension of the gateway. With this arrangement, since the arc-shaped door panel does not intrude inside the compartment, a passerby is smoothly passed through the compartment.

Preferably, the door panel may bulge out of an outer surface of the compartment by increasing the radius of curvature of the arc-shaped door panel. The swivel panel which swings in an area of a small radius assures a large passage area in the compartment.

Preferably, the compartment may have an emergency door. Accordingly, an evacuation passage in emergency is secured.

Also, an inventive door system is provided with a compartment of a rectangular shape in plan view having a longer side in a direction orthogonal to a passing direction of passersby. The compartment is formed with a plurality of pairs of first gateway and second gateway with each pair of first gateway and second gateway being opposed to each other in the passing direction of passersby. The door system is further provided with a barrier apparatus including a plurality of swivel panels each of which swings back and forth within a predetermined angular displacement, a pair of door panels provided at opposite ends of each swivel panel, the pair of door panels operatively opening and closing the first gateway and the second gateway respectively at the same timing while keeping contact with an inner surface of the compartment, and a driving mechanism which synchronously swings the swivel panels back and forth in such a manner that the door panels on the side of the first gateways swing toward and away from each other and the corresponding door panels on the side of the second gateways swing toward and away from each other alternately. This construction can permit an increased traffic in the compartment while securing the draught eliminating effect.

This application is based on Japanese patent application Nos. 2002-95226 and 2002-307330 filed on Mar. 29, 2002 and Oct. 22, 2002, respectively, the contents of which are hereby incorporated by references.

As this invention may be embodied in several forms without departing from the spirit of essential characteristics thereof, the present embodiment is therefore illustrative an not restrictive, since the scope of the invention is defined by the appended claims rather than by the description preceding them, and all changes that fall within metes and bounds of the claims, or equivalence of suck metes and bounds are therefore intended to embraced by the claims.

What is claimed is:

1. A door system comprising:

a compartment formed with a first wall defined by a first pair of substantially parallel, coplanar panels spaced from one another so that opposed edges of the panels in the first pair of panels define a first gateway and a second wall defined by a second pair of substantially parallel, coplanar panels spaced from one another so that opposed edges of the panels in the second pair of panels define a second gateway opposed to the first gateway and internal surfaces of the compartment defining a generally polygonal shape in plan view; and a barrier apparatus which is housed in the compartment, the barrier apparatus including:

a swivel panel with opposite first and second ends and opposite first and second surfaces extending between the ends, the swivel panel being mounted to swing back and forth to assume a first position where the first surface of the swivel panel faces the first gateway, a second position where the second surface of the swivel panel faces the first gateway, and a third position between the first and second positions;

first and second door panels provided at the opposite first and second ends of the swivel panel, the door panels being mounted on the swivel panel such that both door panels respectively open the gateways when the swivel panel assumes the first position and the second position, and such that the door panels respectively close the gateways when the swivel panel assumes the third position, the door panels being interrelated with the compartment to keep substantially air-tight sealing therebetween while the swivel panel is swinging between the first and second positions; and a driving mechanism which operatively swings the swivel panel back and forth between the first and second positions, wherein each of the door panels has an arc shape in plan view, and wherein each of the first and second door panels maintains substantial air-tight sealing contact with at least one of the edges of a respective one of the first and second gateways in all swinging positions of the swivel panel.

2. The door system of claim 1, wherein the door panels define arcs of a cylinder.

3. The door system according to claim 1, wherein brushes are provided on each of the edges of the first and second pair of panels to form said substantial air-tight sealing contact.

4. The door system according to claim 3, wherein the compartment has a quadrangular shape in plan view, and a spacer block is provided at a corner portion of the compartment to fill a space defined by the internal surfaces of the compartment and the door panels when the swivel panel assumes the first and second positions.

5. The door system according to claim 1, wherein the compartment has a quadrangular shape in plan view, and spacer blocks are provided at respective corner portions of the compartment to fill the spaces defined by the internal surfaces of the compartment and the door panels.

* * * * *